US006674007B2

(12) United States Patent
Ide et al.

(10) Patent No.: US 6,674,007 B2
(45) Date of Patent: Jan. 6, 2004

(54) SHIELDING FOR MULTICORE SHIELDED WIRE

(75) Inventors: Tetsuro Ide, Shizuoka (JP); Akira Mita, Shizuoka (JP); Nobuyuki Asakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/128,355

(22) Filed: Apr. 24, 2002

(65) Prior Publication Data

US 2002/0157855 A1 Oct. 31, 2002

(30) Foreign Application Priority Data

Apr. 25, 2001 (JP) ..... 2001-128258

(51) Int. Cl.[7] ..... H01R 4/00
(52) U.S. Cl. ..... 174/84 R; 174/94 R
(58) Field of Search ..... 174/84 R, 92, 174/94 R, 110 R, 113 R, 117 R, 117 F; 156/580.2; 428/60; 439/460; 29/872, 868

(56) References Cited

U.S. PATENT DOCUMENTS

| | | | | |
|---|---|---|---|---|
| 5,329,064 | * | 7/1994 | Tash et al. | 174/36 |
| 5,416,269 | * | 5/1995 | Kemp et al. | 174/36 |
| 5,584,122 | * | 12/1996 | Kato et al. | 29/872 |
| 6,072,124 | * | 6/2000 | Kato et al. | 174/84 R |
| 6,167,616 | * | 1/2001 | Shinchi | 29/861 |
| 6,226,865 | * | 5/2001 | Tanikawa et al. | 29/872 |
| 6,291,771 | * | 9/2001 | Tanikawa et al. | 174/84 R |
| 6,313,407 | * | 11/2001 | Shinchi et al. | 174/84 R |
| 6,528,731 | * | 3/2003 | Murakami et al. | 174/117 F |
| 2002/0084088 | * | 7/2002 | Tanaka et al. | 174/36 |

FOREIGN PATENT DOCUMENTS

| | | | |
|---|---|---|---|
| GB | 1999 09 355 A1 * | 9/1999 | H01R/4/66 |
| JP | 11-135167 | 5/1999 | |

* cited by examiner

*Primary Examiner*—William H. Mayd, III
(74) *Attorney, Agent, or Firm*—Sughrue Mion, PLLC

(57) ABSTRACT

A plurality of shielded core wires has a first diameter. A conductive cover member covers the shielded core wires. A first insulating sheath covers the conductive cover member. A pair of resin members, each formed with a groove having a semi-ellipsoidal shape are thermally integrated with each other for forming an ellipsoidal through hole while accommodating the first insulating sheath therein. A major axis length of a cross section of the ellipsoidal through hole is substantially identical with a length obtained by adding each first diameter, twice a thickness of the conductive cover member and twice a thickness of the first insulating sheath. A minor axis length of a cross section of the ellipsoidal through hole is substantially identical with by adding the first diameter, twice the thickness of the conductive cover member and twice the thickness of the first insulating sheath.

22 Claims, 6 Drawing Sheets

SHIELDING FOR MULTICORE SHIELDED WIRE

BACKGROUND OF THE INVENTION

The present invention relates to the shielding method and structure for a multicore shielded wire for electrically connecting a shielding cover of the multicore shielded wire and a grounding wire.

A related shield processing structure is disclosed in Japanese Patent Publication No. 11-135167A as shown in FIGS. 8 and 9.

In the branching structure shown in these figures, a braided wire 120*d* of a shielded wire 120 is electrically connected to a conductive wire 123*a* of a grounding wire 123 by an ultrasonic horn 125 through a pair of resin members 121 and 122.

In other words, the shielded wire 120 is constituted by one shielding core 120*c* having a core 120*a* covered with an insulating inner sheath 120*b*, a conductive braided wire 120*d* for covering the outer periphery of the shielding core 120*c*, and an insulating outer sheath 120*e* for further covering the outer periphery of the braided wire 120*d*. A pair of resin members 121 and 122 have concave portions 121*b* and 122*b* for forming a hole corresponding to the outer sectional shape of the shielded wire 120 with mutual bonding faces 121*a* and 122*a* butted against each other, respectively. The grounding wire 123 is constituted by the conductive wire 123*a* and an insulating outer sheath 123*b* for covering an outer periphery thereof. The ultrasonic horn 125 is constituted by a lower support base (not shown) provided in a lower part and an ultrasonic horn body 125*a* provided in an upper part.

Next, a branching procedure will be described. The lower resin member 122 is provided on the lower support base (not shown) of the ultrasonic horn 125, the shielded wire 120 is mounted thereabove, one end of the grounding wire 123 is mounted thereon, and furthermore, the upper resin member 121 is put thereabove. Thus, the shielded wire 120 is provided in the concave portions 121*b* and 122*b* of the resin members 121 and 122, and the grounding wire 123 is provided between the shielded wire 120 and the upper resin member 121.

In this state, a vibration is applied by the ultrasonic horn 125 while applying compression force between the resin members 121 and 122. Consequently, the insulating outer sheath 120*e* of the shielded wire 120 and the insulating outer sheath 123*b* of the grounding wire 123 are fused and scattered by the internal heat generation of a vibration energy so that the conductive wire 123*a* of the grounding wire 123 and the braided wire 120*d* of the shielded wire 120 come in electrical contact with each other. Moreover, each of the contact portions of the bonding faces 121*a* and 122*a* of the resin members 121 and 122, the contact portion of the internal peripheral faces of the concave portions 121*b* and 122*b* of the resin members 121 and 122, the insulating outer sheath 120*e* of the shielded wire 120, the contact portion of the insulating resin 123*b* of the grounding wire 123, and the resin members 121 and 122 are fused by the heat generation of the vibration energy and the fused portions are solidified after the ultrasonic vibration is completely applied. Consequently, the resin members 121 and 122, the shielded wire 120 and the grounding wire 123 are fixed to each other.

According to the branch processing, it is not necessary to peel the insulating outer sheaths 120*e* and 123*b* of the shielded wire 120 and the grounding wire 123, and the lower resin member 122, the shielded wire 120, the grounding wire 123 and the upper resin member 121 are simply assembled in this order to give the ultrasonic vibration. Consequently, the number of steps is decreased, and complicated manual work is not required and automation can also be achieved.

In the branching structure, the single core type shielded wire 120 can be properly shielded. However, if the same structure is applied to a multicore type shielded wire having a different internal configuration, the following drawbacks would occur.

More specifically, a multicore shielded wire has such a structure that a plurality of shielded core wires are accommodated with a clearance in the internal space of an insulating outer sheath and a braided wire. For this reason, the degree of close contact and the arrangement relationship between the braided wire and the shielded core wires are indefinite with an interposition between the resin members 121 and 122. In some cases in which the degree of close contact is excessive, the insulating inner sheath of the shielded core wire is broken or cut upon receipt of the transmission of great vibration energy. Consequently, the grounding wire or the shielding cover comes in contact with the core to cause a short circuit, and furthermore, the strength of the multicore shielded wire is reduced.

In order to eliminate such a drawback, it can be proposed that the vibration energy to be applied by the ultrasonic vibration Is reduced. However, in such a condition, a bonding strength based on the fusion and solidification between the resin members 121 and 122 is accordingly reduced.

SUMMARY OF THE INVENTION

It is therefore an object of the invention to provide a structure and a method for shielding a multicore shielded wire in which a short circuit can be prevented from being caused by the contact of a grounding wire or a shielding cover with a core wire so that the strength of the multicore shielded wire can be prevented from being reduced.

In order to achieve the above object, according to the present invention, there is provided a multicore shielded wire, comprising:

- a plurality of shielded core wires, each having a first diameter;
- a conductive cover member, which covers the shielded core wires;
- a first insulating sheath, which covers the conductive cover member; and
- a pair of resin members, each formed with a groove having a semi-ellipsoidal shape and thermally integrated with each other for forming an ellipsoidal through hole while accommodating the first insulating sheath therein,
- wherein a major axis length of a cross section of the ellipsoidal through hole is substantially identical with a length obtained by adding each first diameter, twice a thickness of the conductive cover member and twice a thickness of the first insulating sheath; and
- wherein a minor axis length of a cross section of the ellipsoidal through hole is substantially identical with a length obtained by adding the first diameter, twice the thickness of the conductive cover member and twice the thickness of the first insulating sheath.

Preferably, the multicore shielded wire further comprises a branch wire, in which a conductive core wire is covered with a second insulating sheath, the branch wire sandwiched between the first insulating sheath and one of the resin members. A part of the first insulating sheath and a part of the second insulating sheath are thermally fused so that the conductive cover member and the conductive core wire are electrically connected.

In order to attain the same advantages, according to the present invention, there is also provided a multicore shielded wire, comprising:

a plurality of shielded core wires, each having a first diameter;

at least one drain wire, having a second diameter which is smaller than the first diameter;

a conductive cover member, which covers the shielded core wires and the drain wire;

a first insulating sheath, which covers the conductive cover member, and a pair of resin members, each formed with a groove having a semi-ellipsoidal shape and thermally integrated with each other for forming an ellipsoidal through hole while accommodating the first insulating sheath therein, wherein a major axis length of a cross section of the ellipsoidal through hole is substantially identical with a length obtained by adding each first diameter, the second diameter, twice a thickness of the conductive cover member and twice a thickness of the first insulating sheath; and wherein a minor axis length of a cross section of the ellipsoidal through hole is substantially identical with a length obtained by adding the first diameter, twice the thickness of the conductive cover member and twice the thickness of the first insulating sheath.

Preferably, the multicore shielded wire further comprises a branch wire, in which a conductive core wire is covered with a second insulating sheath, the branch wire sandwiched between the first insulating sheath and one of the resin members. A part of the first insulating sheath and a part of the second insulating sheath are thermally fused so that the conductive cover member and the conductive core wire are electrically connected.

In order to attain the same advantages, according to the present invention, there is also provided a method of shielding a multicore shielded wire, comprising the steps of:

providing a plurality of shielded core wires, each having a first diameter;

covering the shielded core wires with a conductive cover member;

covering the conductive cover member with a first insulating sheath providing a branch wire, in which a conductive core wire is covered with a second insulating sheath;

pressurizing the first insulating sheath so as to have an ellipsoidal cross section in which the shielded core wires are aligned in a major axis direction of the ellipsoidal cross section;

providing a pair of resin members, each formed with a groove having a semi-ellipsoidal shape;

sandwiching the first insulating sheath and the branch wire between the resin members, such that the first insulating sheath is accommodated within an ellipsoidal through hole formed by the grooves and such that the branch wire is placed between the first insulating sheath and one of the resin members;

applying an ultrasonic vibration such that the resin members are integrated with each other, while thermally fusing a part of the first insulating sheath and a part of the second insulating sheath so that the conductive cover member and the conductive core wire are electrically connected, wherein a major axis length of a cross section of the ellipsoidal through hole after the ultrasonic vibration applying step is substantially identical with a length obtained by adding each first diameter, twice a thickness of the conductive cover member and twice a thickness of the first insulating sheath; and wherein a minor axis length of a cross section of the ellipsoidal through hole after the ultrasonic vibration applying step is substantially identical with a length obtained by adding the first diameter, twice the thickness of the conductive cover member and twice the thickness of the first insulating sheath.

In order to attain the same advantages, according to the present invention, there is also provided a method of shielding a multicore shielded wire, comprising the steps of:

providing a plurality of shielded core wires, each having a first diameter;

providing at least one drain wire, having a second diameter which is smaller than the first diameter;

covering the shielded core wires and the drain wire with a conductive cover member;

covering the conductive cover member with a first insulating sheath;

providing a branch wire, in which a conductive core wire is covered with a second insulating sheath;

pressurizing the first insulating sheath so as to have an ellipsoidal cross section in which the shielded core wires and the drain wire are aligned in a major axis direction of the ellipsoidal cross section;

providing a pair of resin members, each formed with a groove having a semi-ellipsoidal shape;

sandwiching the first insulating sheath and the branch wire between the resin members, such that the first insulating sheath is accommodated within an ellipsoidal through hole formed by the grooves and such that the branch wire is placed between the first insulating sheath and one of the resin members;

applying an ultrasonic vibration such that the resin members are integrated with each other, while thermally fusing a part of the first insulating sheath and a part of the second insulating sheath so that the conductive cover member and the conductive core wire are electrically connected, wherein a major axis length of a cross section of the ellipsoidal through hole after the ultrasonic vibration applying step is substantially identical with a length obtained by adding each first diameter, each second diameter, twice a thickness of the conductive cover member and twice a thickness of the first insulating sheath; and wherein a minor axis length of a cross section of the ellipsoidal through hole after the ultrasonic vibration applying step is substantially identical with a length obtained by adding the first diameter, twice the thickness of the conductive cover member and twice the thickness of the first insulating sheath.

In the above configurations, the conductive cover member deforms scarcely even if the pressing force is applied to the multicore shielded wire at the time of sandwiching the multicore shielded wire between the pair of the resin members, the branch wire and the conductive cover member before the fusing process caused by the ultrasonic vibration are disposed at the constant positions, and the plurality of the shielded core wires can scarcely move. Thus, the shielded core wires are not displaced even when the pressure and the ultrasonic vibration is applied. Thus, the insulating sheath of the shielded core wires are not broken or out due to the heat generated by the ultrasonic vibration.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Hereinafter, the preferred embodiments of the invention will be explained with reference to the accompanying drawings.

Figure 1:
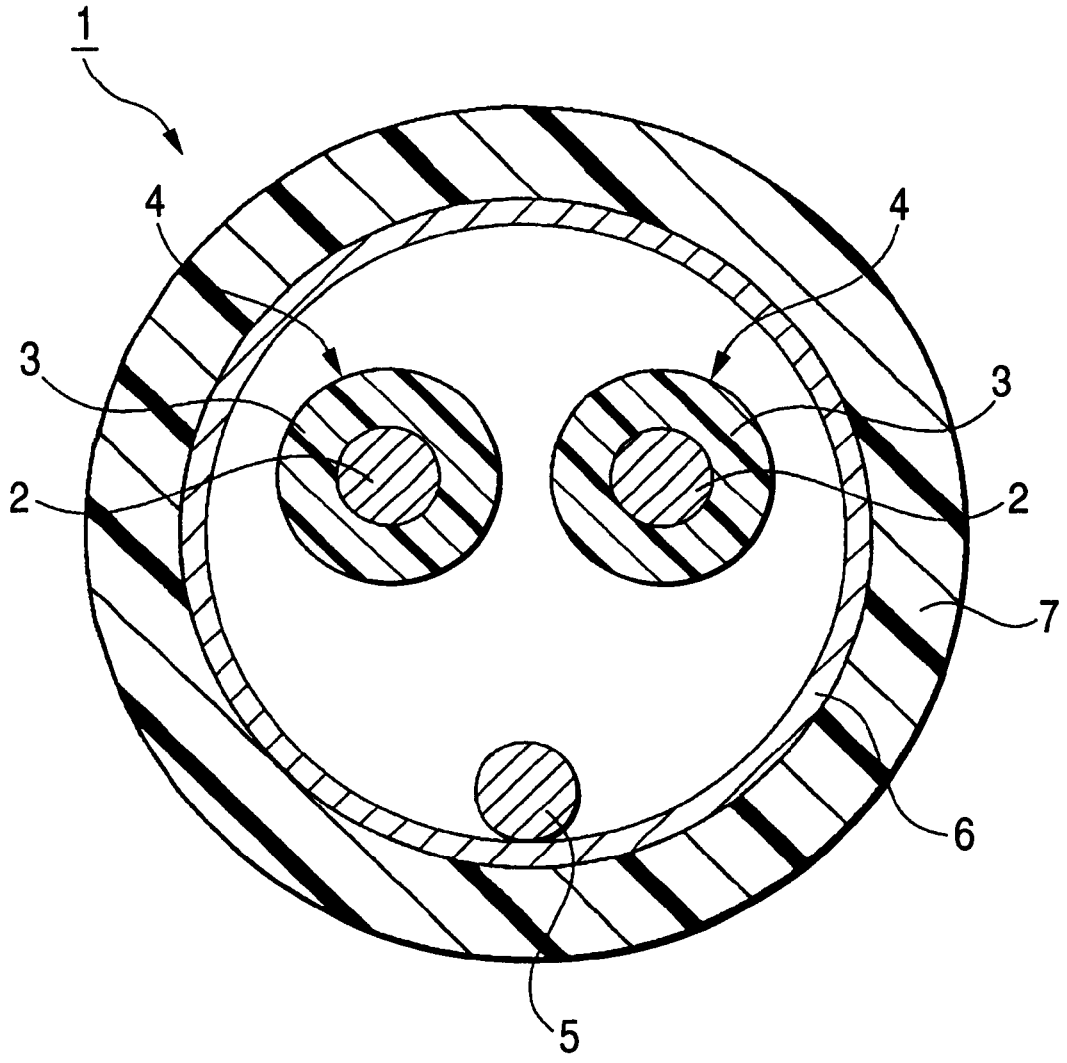
FIG. 1 is a sectional view of a multicore shielded wire according to an embodiment of the invention.

FIG. 1 shows a multicore shielded wire according to one embodiment of the invention. The multicore shielded wire 1 is constituted by two shielded core wires 4 each having a core wire 2 covered with an insulating inner sheath 3, a drain wire 5, an aluminum foil to be a shielding cover 6 for covering the outer periphery of the two shielded core wires 4 and the drain wire 5, and an insulating outer sheath 7 for further covering the outer periphery of the shielding cover 6. The insulating inner sheath 3 and the insulating outer sheath 7 are formed of a synthetic resin, and the core wire 2 and the drain wire 5 are formed of a conductive material.

Figure 2:
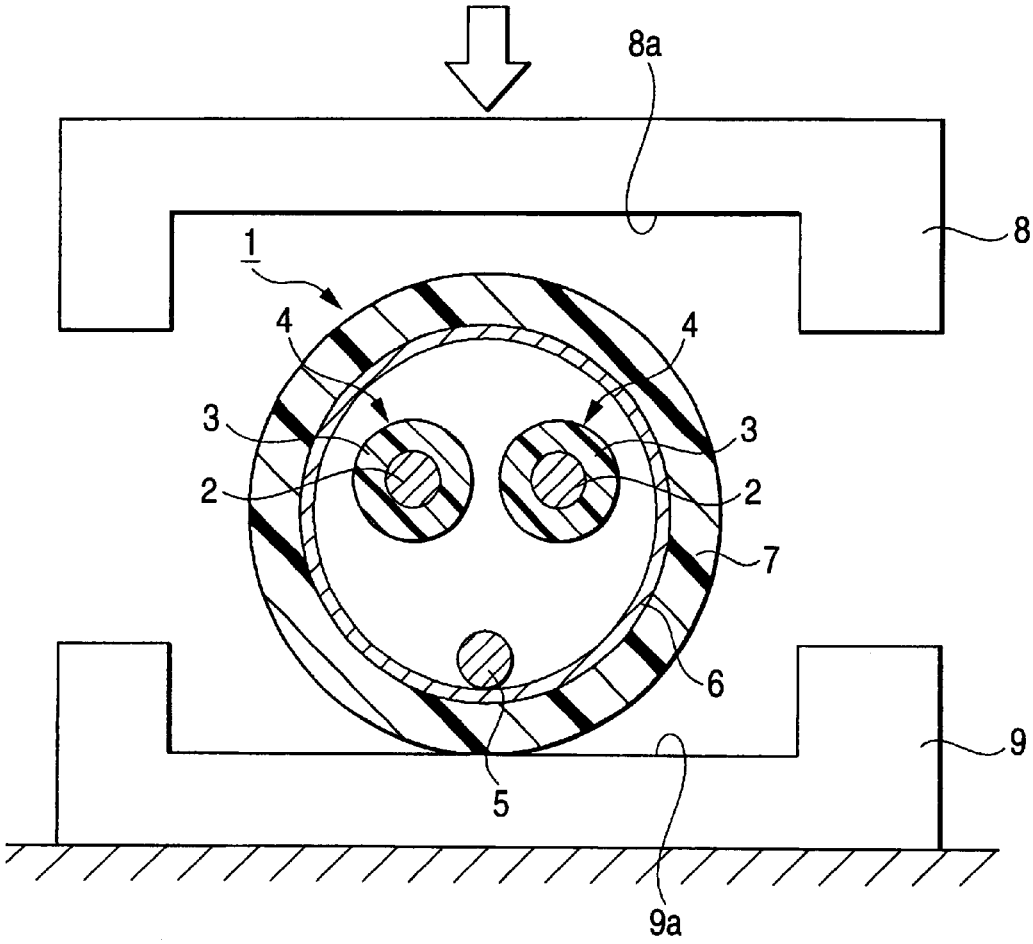
FIG. 2 is a diagram showing a shape forming processing for the multicore shielded wire.
Figure 3:
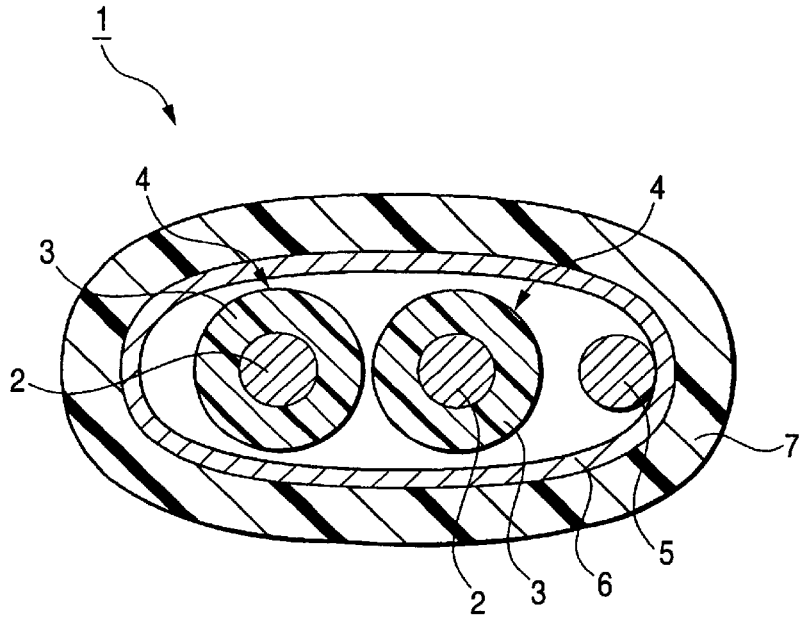
FIG. 3 is a sectional diagram of the multicore shielded wire having been subjected to the shape forming processing.

As shown in FIG. 2, the multicore shielded wire 1 having the almost circular shape In its outer sectional configuration is deformed in its shape by a pair of upper and lower deformation jigs 8, 9 made of resin and having shallow recess portions 8*a*, 9*a* on their opposing sides thereof, respectively. That is, the multicore shielded wire 1 is disposed between the pair of upper and lower deformation jigs 8, 9 and is compressed in the elevational direction by the jigs 8, 9. Thus, the multicore shielded wire 1 is deformed while being restricted by the recess portions 8*a*, 9*a*. Then, as shown in FIG. 3, the multicore shielded wire 1 is deformed in a manner that the two shielded core wires 4 and the drain wire 5 are laterally aligned in a line so as to have an almost elliptical shape in the outer sectional configuration of the multicore shielded wire. In this respect, although in FIG. 3 the two shielded core wires 4 and the drain wire 5 are disposed in the order of the shielded core wire 4, the shielded core wire 4 and the drain wire 5 from the left side, these wires may be disposed in any order so long as the two shielded core wires 4 and the drain wire 5 are laterally aligned in a line.

Figure 4:
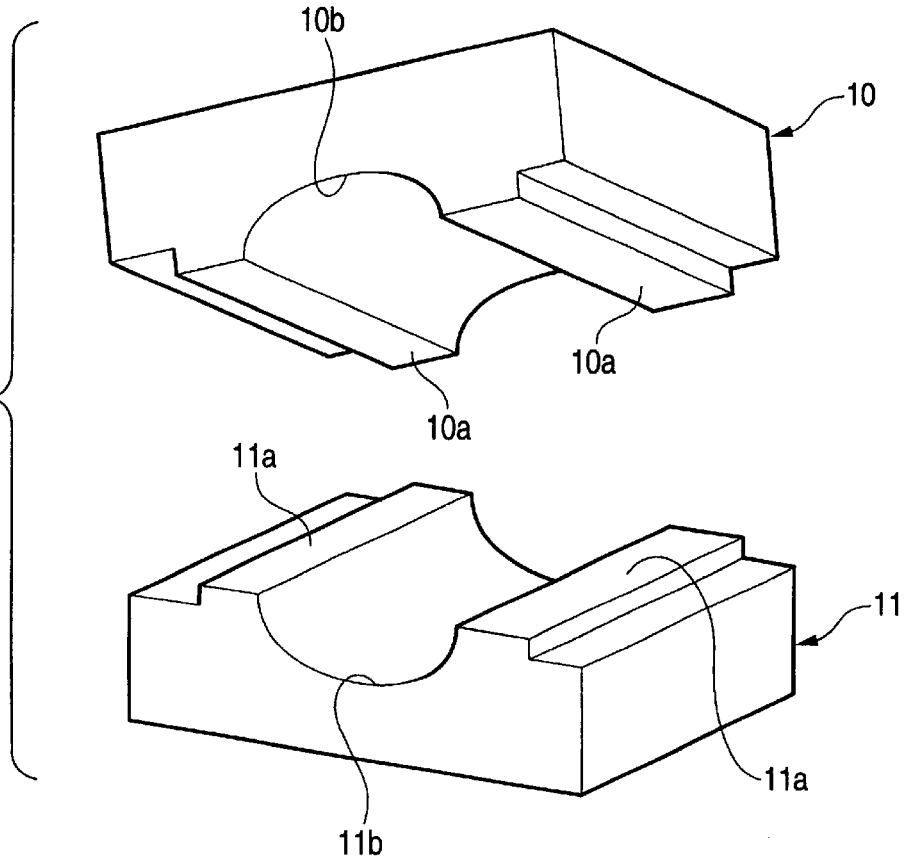
FIG. 4 is a perspective view of a pair of resin members used for the multicore shielded wire.

As shown In FIG. 4, a pair of resin members 10 and 11 are blocks having the same shape and formed of a synthetic resin, and concave portions 10*b* and 11*b* for forming a hole almost corresponding to the outer sectional shape of the shielded wire 1 are formed with mutual bonding faces 10*a* and 11*a* abutted against each other, respectively. In detail, each of the recess portions 10*b*, 11*b* is a groove of an almost semi-elliptical shape formed by dividing the elliptical shape of the multicore shielded wire 1.

Figure 6:
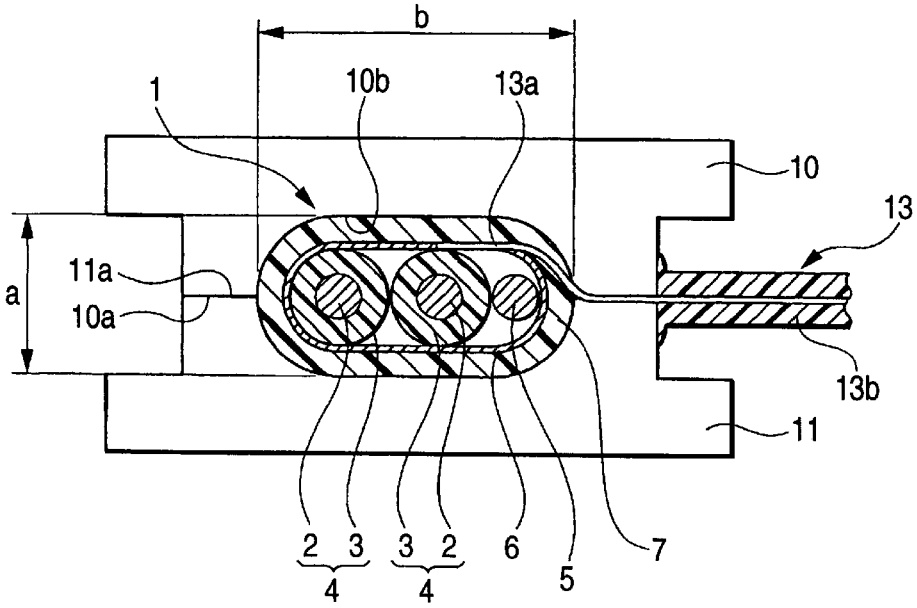
FIG. 6 is a diagram showing the shielding structure obtained by the application of the ultrasonic vibration.

As shown in FIG. 6, the hole of the almost elliptical shape formed by abutting the surfaces 10*a*, 11*a* to each other is set in a manner that a length a in the minor axis direction thereof is the sum of the outer diameter of the shielded core wire 4 and twice the thickness of the shielding cover 6 and the insulating outer sheath 7. Further, the hole is set in a manner that a length b in the major axis direction thereof is sum of twice the outer diameter of the shielded core wire 4, the outer diameter of the drain wire 5 and twice the thickness of the shielding cover 6 and the insulating outer sheath 7.

As to the physical properties of the resin members 10 and 11, moreover, they are less fused than the insulating outer sheath 7 and are formed of an acryl based resin, an TABS (acrylonitrile-butadiene-styrene copolymer) based resin, a PC (polycarbonate) based resin, a PE (polyethylene) based resin, a PEI (polyetherimide) based resin or a PBT (polybutylene terephthalate) based resin, and are generally harder than vinyl chloride to be used for the insulating outer sheath 7.

In respect of conductivity and conductive safety, practicality is required for all the resins described above and the PEI (polyether imide) based resin and the PBT (polybutylene terephthalate) based resin are particularly suitable if a decision is carried out including appearance and insulating properties.

Figure 5:
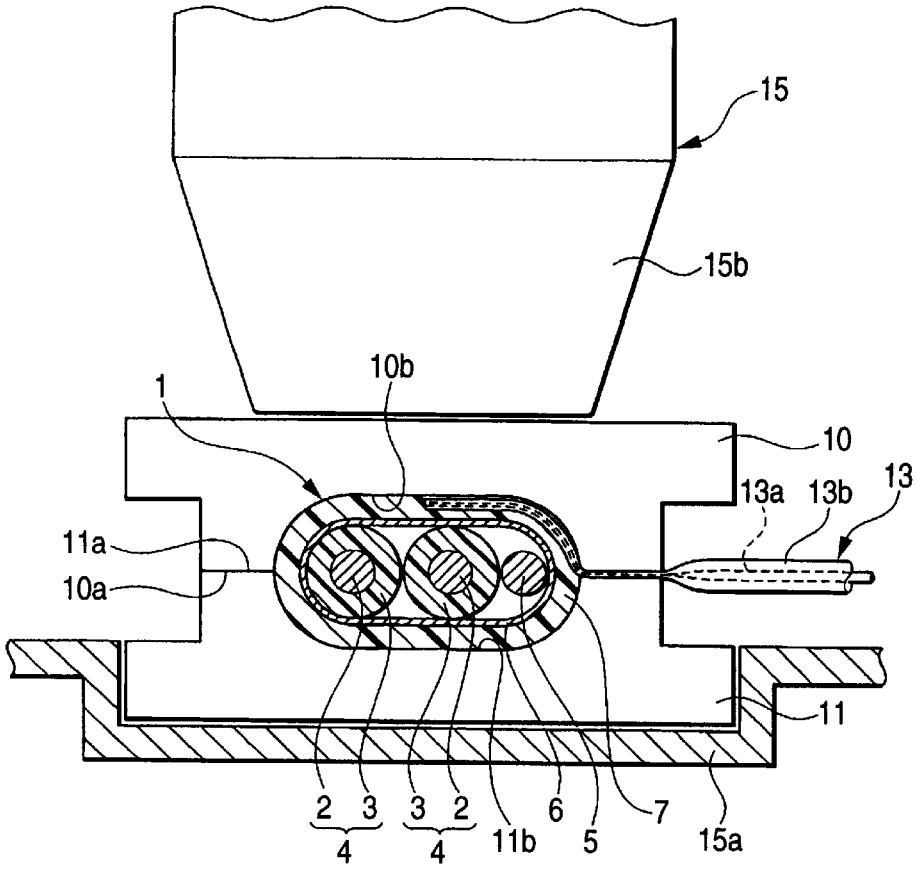
FIG. 5 is a diagram showing a setting state of respective members before applying ultrasonic vibration thereto.

As shown in FIG. 5, the grounding wire 13 Is configured by a conductive wire 13*a* and an insulating outer sheath 13*b* covering the outer periphery thereof.

As shown in FIG. 5, an ultrasonic horn 15 is configured by a lower support base 15*a* capable of positioning the resin member 11 disposed beneath and an ultrasonic horn body 15*b* disposed just above the lower support base 15*a* and capable of applying ultrasonic vibration while acting pressing force beneath.

Next, the shielding procedure will be explained. First, the shape forming processing is performed in which a portion in the vicinity of the end portion of the multicore shielded wire 1 having a circular shape in its outer sectional configuration is formed into an almost elliptical shape in its outer sectional configuration by using the deformation jigs 8, 9. According to the shape forming processing, as shown in FIG. 3, the multicore shielded wire 1 is deformed in a manner that the two shielded core wires 4 and the drain wire 5 are laterally aligned in a line so as to have an almost elliptical shape in the outer sectional configuration of the multicore shielded wire.

Next, as shown in FIG. 5, the resin member 11 on the lower side is disposed on the lower support base 15*a* of the ultrasonic horn 15, then the portion near the end portion of the multicore shielded wire 1 having been subjected to the shape forming processing is disposed on the resin member, then the one end side of the grounding wire 13 is disposed on the multicore shielded wire, and the resin 10 on the upper side is covered over the multicore shielded wire and the grounding wire. In this manner, the multicore shielded wire 1 is disposed within the recess portions 10*b*, 11*b* of the pair of the resin members 10, 11, and the one end of the grounding wire 13 is disposed between the multicore shielded wire 1 and the upper resin member 11.

Next, the ultrasonic horn body 15*b* is brought down to give a vibration through the ultrasonic horn 15 while applying the compression force between the resin members 10 and 11. Consequently, the insulating outer sheath 7 of the shielded wire 1 and the insulating outer sheath 13*b* of the grounding wire 13 are fused and scattered by the internal heat generation of a vibration energy so that the conductive wire 13*a* of the grounding wire 13 and the aluminum foil 6 of the shielded wire 1 come in electric contact with each other (see FIG. 6).

Figure 7:
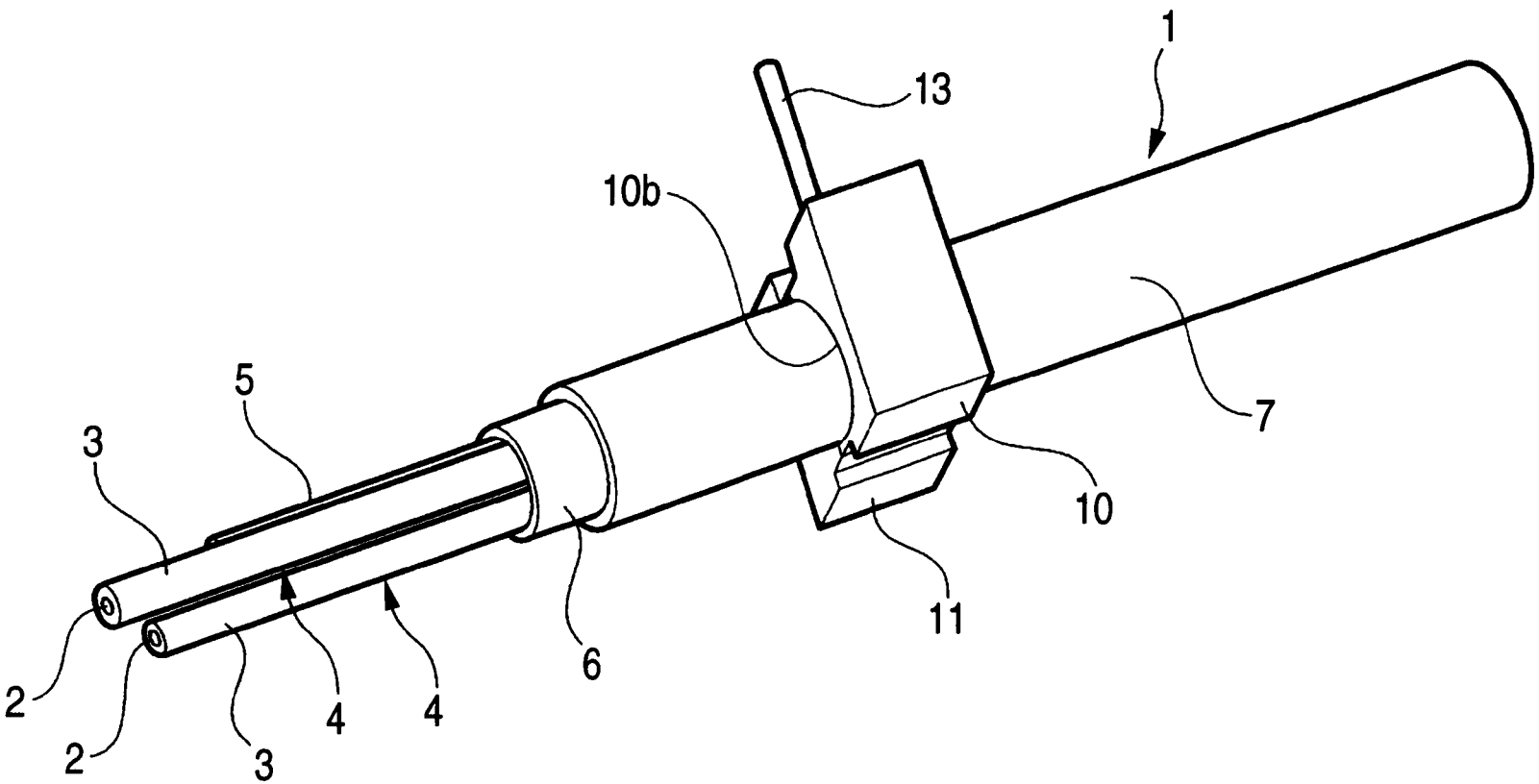
FIG. 7 is a perspective view of the multicore shielded wire obtained by the shielding of the invention.
Figure 8:
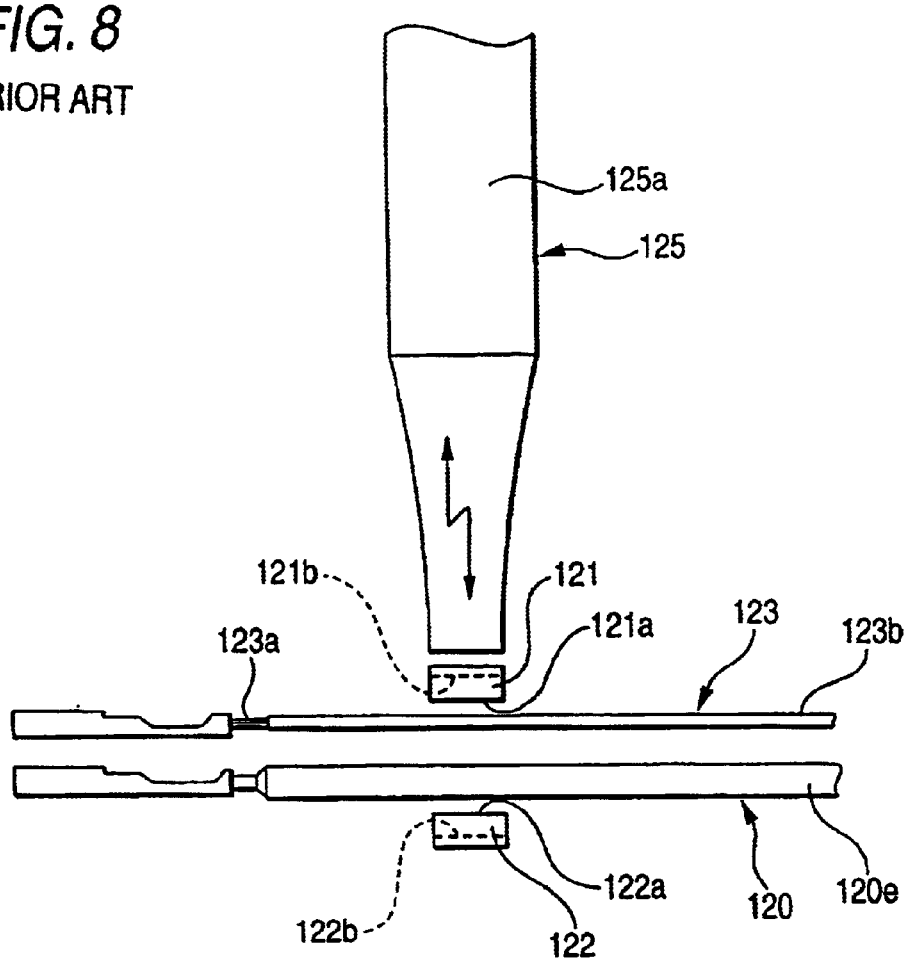
FIG. 8 PRIOR ART
FIG. 8 Is a front view showing a shielding structure according to a related art.
Figure 9:
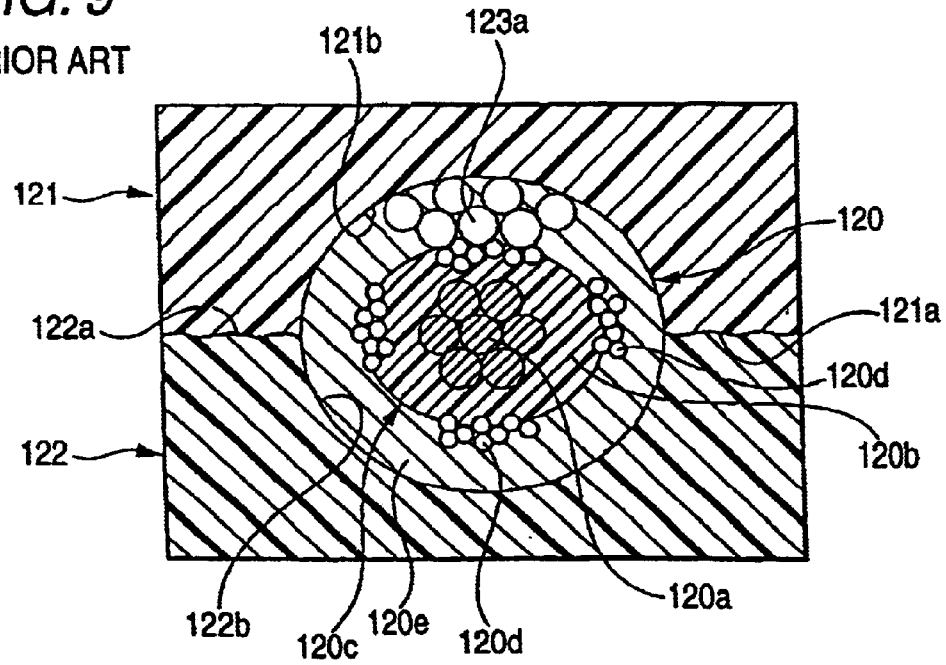
FIG. 9 PRIOR ART
FIG. 9 is a sectional view showing the shielding structure according to the third related art.

Moreover, each of the contact portions of the bonding faces 10*a* and 11*a* of the resin members 10 and 11, the contact portion of the internal peripheral faces of the concave portions 10*b* and 11*b* of the resin members 10 and 11 and the insulating outer sheath 7 of the shielded wire 1, and the contact portion of the insulating resin 13*b* of the grounding wire 13 and the resin members 10 and 11 are fused by the internal heat generation of the vibration energy and the fused portions are solidified after the ultrasonic vibration is completely applied. Consequently, the resin members 10 and 11, the shielded wire 1 and the grounding wire 13 are fixed to each other (see FIGS. 6 and 7).

Consequently, it is not necessary to peel the insulating outer sheaths 7 and 13*b* of the shielded wire 1 and the grounding wire 13 and it is preferable that the lower resin member 11, the shielded wire 1, the grounding wire 13 and the upper resin member 10 should be assembled in this order to give the ultrasonic vibration. Therefore, the number of steps is decreased, and a complicated manual work is not required and automation can also be achieved.

In the aforesaid processing, in the multicore shielded wire 1, the plurality of the shielded core wires 4 scarcely move due to the holding force between the pair of the resin members 10, 11. Further, the multicore shielded wire is deformed in such an outer configuration that the shielding cover 6 scarcely deforms. Thus, the shielding cover 6 also scarcely deforms (moves) due to the pressing force generated when the multicore shielded wire 1 is sandwiched between the pair of the resin members 10, 11, and the grounding wire 13 and the shielding cover 6 before the fusing process caused by the ultrasonic vibration are disposed at the constant positions. Therefore, the grounding wire 13 and the shielding cover 6 can be surely made in contact electrically to each other due to the fusing process and so the electric efficiency can be improved.

Further, since the two shielded core wires 4 can scarcely move, the two shielded core wires do not vary in their positions even when the pressure and the ultrasonic vibration is applied between the pair of the resin members 10, 11 at the time of the fusing process. Thus, the insulation inner covers 3 of the shielded core wires 4 are not broken or cut due to the heat generated by the ultrasonic vibration, and so the occurrence of the short-circuit between the grounding wire 13 and the core wire 2 and between the core wires 2 can be surely prevented and the insulation efficiency can be improved.

In the aforesaid embodiment, since the shape forming processing of the multicore shielded wire 1 is performed in a manner that the multicore shielded wire is deformed by the compression force applied from the outside to have an almost elliptical shape in its outer sectional configuration so that the two shielded core wires 4 are laterally aligned in a line. Thus, it is merely required to apply the compression force to the multicore shielded wire 1 from the elevational direction, for example, such a forming processing can be conducted easily.

In the above embodiment, when a plated wire having a relatively low melting temperature such as a tin plated electric wire is used as the conductive wire 13*a* of the grounding wire 13, the plated wire is partially fused by a vibration energy and better electric contact with the shielding cover 6 can be obtained. Therefore, a reliability in the contact portion of the shielding cover 6 and the conductive wire 13*a* of the grounding wire 13 can be enhanced. The relatively low melting temperature can be defined as a temperature which is lower than a temperature of the internal heat generated by the ultrasonic vibration.

In the above embodiment, the sizes a and b of the hole formed by the recess portions 10*b*, 11*b* of the resin members 10, 11 are set to have such values capable of housing the multicore shielded wire 1 without leaving any clearance. Thus, since the members of the multicore shielded wire 1 can scarcely move on or after the fusing process caused by the ultrasonic vibration, a very rigid shielding structure can be obtained. In this respect, even if the sizes a and b of the hole formed by the resin members 10, 11 are set to have such values that the hole has a clearance slightly with respect to the outer configuration size of the multicore shielded wire 1, the similar effects can be obtained.

While the insulating outer sheath 13*b* is not peeled when the grounding wire 13 is arranged between the resin member and the shielded wire in the above embodiments, the insulating outer sheath 13*b* may be peeled. Furthermore, the contact connection of the shielding cover 6 and the conductive wire 13*a* is not restricted to thermal fusing based on an ultrasonic vibration.

While the aluminum foil 6 is used for the shielding cover 6 in the above embodiments, a conductive metal other than aluminum, particularly, a material having an excellent rolling property can also be used. Alternatively, a braided wire may be adopted as the shielding cover 6.

While the multicore shielded wire is provided with the drain wire 5 in the above embodiments, the drain wire 5 does not need to be always provided. If the drain wire 5 is provided, the shielding can also be carried out by earthing the drain wire 5. Therefore, there is an advantage that a variation in a countermeasure against the shielding can be increased correspondingly.

Although in the above embodiment, the explanation has been made as to the case where the multicore shielded wire 1 has the two shielded care wires 4, it goes without saying that the invention is also applied to the case where the multicore shielded wire has three or more shielded core wires 4.

What is claimed is:

1. A multicore shielded wire, comprising:

a plurality of shielded core wires, each having a first diameter;

a conductive cover member, which covers the shielded core wires;

a first insulating sheath, which covers the conductive cover member; and a pair of resin members, each formed with a groove having a semi-ellipsoidal shape and thermally integrated with each other for forming an ellipsoidal through hole while accommodating the first insulating sheath therein, wherein a major axis length of a cross section of the ellipsoidal through hole is substantially identical with a length obtained by adding each first diameter, twice a thickness of the conductive cover member and twice a thickness of the first insulating sheath; and wherein a minor axis length of a cross section of the ellipsoidal through hole is substantially identical with a length obtained by adding the first diameter, twice the thickness of the conductive cover member and twice the thickness of the first insulating sheath.

2. The multicore shielded wire as set forth in claim 1, further comprising a branch wire, in which a conductive core wire is covered with a second insulating sheath, the branch wire sandwiched between the first insulating sheath and one of the resin members, wherein a part of the first insulating sheath and a part of the second insulating sheath are thermally fused so that the conductive cover member and the conductive core wire are electrically connected.

3. The multicore shielding wire as set forth in claim 1, wherein said pair of resin members are made from a material chosen from the group comprising an acryl based resin, an acrylonitrile-butadiene-styrene copolymer based resin, a polycarbonate based resin, a polyethylene based resin, a polyetherimide based resin and a polybutylene terephthalate based resin.

4. The multicore shielding wire as set forth in claim 1, wherein said pair of resin members are made from a material which is harder than said first insulating sheath.

5. The multicore shielding wire as set forth in claim 1, wherein said conductive core wire has a low melting temperature.

6. The multicore shielding wire as set forth in claim 1, wherein said conductive core wire has a melting temperature lower than a temperature of heat generated by an ultrasonic vibration used to thermally fuse said parts of said first and second insulating sheaths.

7. A multicore shielded wire, comprising:

a plurality of shielded core wires, each having a first diameter;

at least one drain wire, having a second diameter which is smaller than the first diameter;

a conductive cover member, which covers the shielded core wires and the drain wire;

a first insulating sheath, which covers the conductive cover member; and a pair of resin members, each formed with a groove having a semi-ellipsoidal shape and thermally integrated with each other for forming an ellipsoidal through hole while accommodating the first insulating sheath therein, wherein a major axis length of a cross section of the ellipsoidal through hole is substantially identical with a length obtained by adding each first diameter, the second diameter, twice a thickness of the conductive cover member and twice a thickness of the first insulating sheath; and wherein a minor axis length of a cross section of the ellipsoidal through hole is substantially identical with a length obtained by adding the first diameter, twice the thickness of the conductive cover member and twice the thickness of the first insulating sheath.

8. The multicore shielded wire as set forth in claim 7, further comprising a branch wire, in which a conductive core wire is covered with a second insulating sheath, the branch wire sandwiched between the first insulating sheath and one of the resin members, wherein a part of the first insulating sheath and a part of the second insulating sheath are thermally fused so that the conductive cover member and the conductive core wire are electrically connected.

9. The multicore shielding wire as set forth in claim 12, wherein said pair of resin members are made from a material chosen from the group comprising an acryl based resin, an acrylonitrile-butadiene-styrene copolymer based resin, a polycarbonate based resin, a polyethylene based resin, a polyetherimide based resin and a polybutylene terephthalate based resin.

10. The multicore shielding wire as set forth in claim 7, wherein said pair of resin members are made from a material which is harder than said first insulating sheath.

11. The multicore shielding wire as set forth in claim 7, wherein said conductive core wire has a low melting temperature.

12. The multicore shielding wire as set forth in claim 7, wherein said conductive core wire has a melting temperature lower than a temperature of heat generated by an ultrasonic vibration used to thermally fuse said parts of said first and second insulating sheaths.

13. A method of shielding a multicore shielded wire, comprising the steps of:

providing a plurality of shielded core wires, each having a first diameter;

covering the shielded core wires with a conductive cover member;

covering the conductive cover member with a first insulating sheath;

providing a branch wire, in which a conductive core wire is covered with a second insulating sheath;

pressurizing the first insulating sheath so as to have an ellipsoidal cross section in which the shielded core wires are aligned in a major axis direction of the ellipsoidal cross section;

providing a pair of resin members, each formed with a groove having a semi-ellipsoidal shape;

sandwiching the first insulating sheath and the branch wire between the resin members, such that the first insulating sheath is accommodated within an ellipsoidal through hole formed by the grooves and such that the branch wire is placed between the first insulating sheath and one of the resin members;

applying an ultrasonic vibration such that the resin members are integrated with each other, while thermally fusing a part of the first insulating sheath and a part of the second insulating sheath so that the conductive cover member and the conductive core wire are electrically connected, wherein a major axis length of a cross section of the ellipsoidal through hole after the ultrasonic vibration applying step is substantially identical with a length obtained by adding each first diameter, twice a thickness of the conductive cover member and twice a thickness of the first insulating sheath; and wherein a minor axis length of a cross section of the ellipsoidal through hole after the ultrasonic vibration applying step is substantially identical with a length obtained by adding the first diameter, twice the thickness of the conductive cover member and twice the thickness of the first insulating sheath.

14. The multicore shielding wire as set forth in claim 13, wherein said pair of resin members are made from a material chosen from the group comprising an acryl based resin, an acrylonitrile-butadiene-styrene copolymer based resin, a polycarbonate based resin, a polyethylene based resin, a polyetherimide based resin and a polybutylene terephthalate based resin.

15. The multicore shielding wire as set forth in claim 13, wherein said pair of resin members are made from a material which is harder than said first insulating sheath.

16. The multicore shielding wire as set forth in claim 13, wherein said conductive core wire has a low melting temperature.

17. The multicore shielding wire as set forth in claim 13, wherein said conductive core wire has a melting temperature lower than a temperature of heat generated by an ultrasonic vibration used to thermally fuse said parts of said first and second insulating sheaths.

18. A method of shielding a multicore shielded wire, comprising the steps of:

providing a plurality of shielded core wires, each having a first diameter;

providing at least one drain wire, having a second diameter which is smaller than the first diameter;

covering the shielded core wires and the drain wire with a conductive cover member;

covering the conductive cover member with a first insulating sheath;

providing a branch wire, in which a conductive core wire is covered with a second insulating sheath;

pressurizing the first insulating sheath so as to have an ellipsoidal cross section in which the shielded core wires and the drain wire are aligned in a major axis direction of the ellipsoidal cross section;

providing a pair of resin members, each formed with a groove having a semi-ellipsoidal shape;

sandwiching the first insulating sheath and the branch wire between the resin members, such that the first insulating sheath is accommodated within an ellipsoidal through hole formed by the grooves and such that the branch wire is placed between the first insulating sheath and one of the resin members;

applying an ultrasonic vibration such that the resin members are integrated with each other, while thermally fusing a part of the first insulating sheath and a part of the second insulating sheath so that the conductive cover member and the conductive core wire are electrically connected, wherein a major axis length of a cross section of the ellipsoidal through hole after the ultrasonic vibration applying step is substantially identical with a length obtained by adding each first diameter, each second diameter, twice a thickness of the conductive cover member and twice a thickness of the first insulating sheath; and wherein a minor axis length of a cross section of the ellipsoidal through hole after the ultrasonic vibration applying step is substantially identical with a length obtained by adding the first diameter, twice the thickness of the conductive cover member and twice the thickness of the first insulating sheath.

19. The multicore shielding wire as set forth in claim 18, wherein said pair of resin members are made from a material chosen from the group comprising an acryl based resin, an acrylonitrile-butadiene-styrene copolymer based resin, a polycarbonate based resin, a polyethylene based resin, a polyetherimide based resin and a polybutylene terephthalate based resin.

20. The multicore shielding wire as set forth in claim 18, wherein said pair of resin members are made from a material which is harder than said first insulating sheath.

21. The multicore shielding wire as set forth in claim 18, wherein said conductive core wire has a low melting temperature.

22. The multicore shielding wire as set forth in claim 18, wherein said conductive core wire has a melting temperature lower than a temperature of heat generated by an ultrasonic vibration used to thermally fuse said parts of said first and second insulating sheaths.

* * * * *